US008813491B2

(12) United States Patent
Brinkmann

(10) Patent No.: US 8,813,491 B2
(45) Date of Patent: Aug. 26, 2014

(54) SUPERCHARGED LIQUID-COOLED INTERNAL COMBUSTION ENGINE

(75) Inventor: Bernd Brinkmann, Dormagen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 146 days.

(21) Appl. No.: 13/331,823

(22) Filed: Dec. 20, 2011

(65) Prior Publication Data

US 2012/0174579 A1 Jul. 12, 2012

(30) Foreign Application Priority Data

Jan. 12, 2011 (DE) ..... 10 2011 002 562

(51) Int. Cl.

| | |
|---|---|
| ***F02B 33/44*** | (2006.01) |
| ***F01P 1/06*** | (2006.01) |
| ***F01P 11/08*** | (2006.01) |
| ***F01P 3/20*** | (2006.01) |

(52) U.S. Cl.

CPC ..... *F01P 3/20* (2013.01); *F01P 2060/12* (2013.01)

USPC ..... 60/605.3; 123/41.31; 123/41.33

(58) Field of Classification Search

USPC ..... 60/605.3, 599; 123/41.31

See application file for complete search history.

(56) References Cited

U.S. PATENT DOCUMENTS

| | | | | |
|---|---|---|---|---|
| 3,057,436 | A * | 10/1962 | Jacobson et al. | 60/605.3 |
| 3,090,544 | A * | 5/1963 | Woollenweber, Jr. et al. | 415/111 |
| 4,561,387 | A * | 12/1985 | Korkemeier et al. | 60/605.3 |
| 4,752,193 | A * | 6/1988 | Horler | 417/407 |
| 4,829,939 | A * | 5/1989 | Veenemans et al. | 60/605.3 |
| 4,928,637 | A * | 5/1990 | Naitoh et al. | 60/605.3 |
| 4,958,600 | A * | 9/1990 | Janthur | 123/41.31 |
| 5,095,704 | A | 3/1992 | Nagura et al. | |
| 2010/0284824 | A1* | 11/2010 | Hippen et al. | 415/110 |

FOREIGN PATENT DOCUMENTS

| | | | |
|---|---|---|---|
| DE | 102008011257 | A1 | 9/2009 |
| DE | 102008021263 | A1 | 11/2009 |
| EP | 1384857 | A2 | 1/2004 |
| EP | 2039902 | A2 | 3/2009 |
| JP | 01080720 | A * | 3/1989 |

OTHER PUBLICATIONS

Machine translation of DE 102008021263A1 (pub. Nov. 12, 2009).*

* cited by examiner

*Primary Examiner* — Thai Ba Trieu
*Assistant Examiner* — Ngoc T Nguyen
(74) *Attorney, Agent, or Firm* — Julia Voutyras; Alleman Hall McCoy Russell & Tuttle LLP

(57) ABSTRACT

A supercharged liquid-cooled internal combustion engine is provided. In one example, a bearing of a turbocharger is cooled in response to a thermal load of the turbocharger while a flow of coolant to a ventilation vessel is controlled. In this way, a coolant flow rate to the bearing and a ventilation vessel may be provided based on cooling demand.

19 Claims, 3 Drawing Sheets

SUPERCHARGED LIQUID-COOLED INTERNAL COMBUSTION ENGINE

RELATED APPLICATIONS

The present application claims priority to German Patent Application No. 102011002562.6, filed on Jan. 12, 2011, the entire contents of which are hereby incorporated by reference for all purposes.

FIELD

The disclosure relates to a supercharged liquid-cooled internal combustion engine.

BACKGROUND AND SUMMARY

To form the individual cylinders of the internal combustion engine, at least one cylinder head is connected at an assembly end side to a cylinder block. To hold the pistons or the cylinder liners, the cylinder block, which at least jointly forms the crankcase, has a corresponding number of cylinder bores. The pistons are guided in the cylinder liners in an axially movable fashion and form, together with the cylinder liners and the cylinder head, the combustion chambers of the internal combustion engine.

Internal combustion engines are ever more commonly being supercharged, wherein supercharging is primarily a method of increasing power, in which the air for the combustion process in the engine is compressed. The economical significance of said engines for the automobile industry is ever increasing.

In general, for supercharging, use is made of an exhaust-gas turbocharger in which a compressor and a turbine are arranged on the same shaft, with the hot exhaust-gas flow being supplied to the turbine and expanding in said turbine with a release of energy, as a result of which the shaft, which is mounted in a bearing housing, is set in rotation. The energy supplied by the exhaust-gas flow to the turbine and ultimately to the shaft is used for driving the compressor which is likewise arranged on the shaft. The compressor conveys and compresses the charge air supplied to it, as a result of which supercharging of the cylinders is obtained.

The advantage of the exhaust-gas turbocharger for example in relation to a mechanical charger is that no mechanical connection for transmitting power is required between the charger and internal combustion engine. While a mechanical charger extracts the energy required for driving it entirely from the internal combustion engine, and thereby reduces the output power and consequently adversely affects the efficiency, the exhaust-gas turbocharger utilizes the exhaust-gas energy of the hot exhaust gases.

Supercharged internal combustion engines are commonly equipped with a charge-air cooling arrangement by which the compressed combustion air is cooled before it enters the cylinders. In this way, the density of the supplied charge air is increased further. In this way, the cooling likewise contributes to a compression and effective charging of the combustion chambers, that is to say to an improved volumetric efficiency.

Supercharging is suitable for increasing the power of an internal combustion engine while maintaining an unchanged swept volume, or for reducing the swept volume while maintaining the same power. In any case, supercharging leads to an increase in volumetric power output and an improved power-to-weight ratio. For the same vehicle boundary conditions, it is thus possible to shift the load collective toward higher loads, where the specific fuel consumption is lower. This is also referred to as downsizing.

Problems are encountered in the configuration of the exhaust-gas turbocharging, wherein it is basically sought to obtain a noticeable performance increase in all rotational speed ranges. A severe torque drop is commonly observed in the event of a certain rotational speed being undershot. It has previously been sought to improve the torque characteristic of a supercharged internal combustion engine by various measures, for example by a small design of the turbine cross section and simultaneous exhaust-gas blow-off. If the exhaust-gas mass flow exceeds a critical value, a part of the exhaust-gas flow is, within the course of the exhaust-gas blow-off, conducted via a bypass line past the so-called wastegate turbine. Said approach however has disadvantages at relatively high rotational speeds.

The torque characteristic of a supercharged internal combustion engine may also be improved by virtue of a plurality of chargers—exhaust-gas turbochargers and/or mechanical chargers—being provided in the exhaust-gas discharge system in a parallel and/or series arrangement.

A supercharged internal combustion engine is thermally more highly loaded, owing to the increased mean pressure, than a conventional naturally aspirated engine, and therefore also places increased demands on the cooling arrangement. To keep the thermal loading within limits, a supercharged internal combustion engine is generally equipped with a cooling arrangement, hereinafter also referred to as engine cooling arrangement. It is fundamentally possible for the cooling arrangement to take the form of an air-cooling arrangement or a liquid-cooling arrangement. Since significantly greater amounts of heat can be dissipated by a liquid-cooling arrangement, an internal combustion engine of the present type is generally provided with a liquid-cooling arrangement. The internal combustion engine according to the disclosure is also a liquid-cooled internal combustion engine.

Liquid cooling requires that the internal combustion engine, that is to say the at least one cylinder head and/or the cylinder block, be equipped with a coolant jacket, that is to say requires the provision of coolant ducts which conduct the coolant through the cylinder head or block, which entails a complex structure. Here, the mechanically and thermally highly loaded cylinder head or block is firstly weakened in terms of its strength as a result of the provision of the coolant ducts. Secondly, the heat need not firstly be conducted to the surface to be dissipated, as is the case with the air-cooling arrangement. The heat is dissipated to the coolant, generally water provided with additives, already in the interior of the cylinder head or block. Here, the coolant is conveyed, such that it circulates, by means of a pump which is arranged in the cooling circuit and which is generally mechanically driven by means of a traction mechanism drive. The heat dissipated to the coolant is discharged from the interior of the cylinder head or block in this way, and is extracted from the coolant again in a heat exchanger. A ventilation vessel provided in the cooling circuit serves for ventilating the coolant or the circuit.

Like the internal combustion engine itself, the turbine of the at least one exhaust-gas turbocharger is likewise thermally highly loaded. As a result, the turbine housing according to the previous systems is produced from heat-resistant, often nickel-containing material, or equipped with a liquid-cooling arrangement in order to be able to use less heat-resistant materials. EP 1 384 857 A2 and the German laid-open specification DE 10 2008 011 257 A1 describe liquid-cooled turbines and turbine housings.

The hot exhaust gas of the supercharged internal combustion engine also leads to high thermal loading of the bearing housing and consequently of the bearing of the charger shaft. Associated with this is the introduction of a correspondingly large amount of heat into the oil which is supplied to the bearing for the purpose of lubrication. On account of the high rotational speed of the charger shaft, the bearing is formed generally not as a rolling bearing but rather as a plain bearing. As a result of the relative movement between the shaft and the bearing housing, a hydrodynamic lubricating film, which is capable of supporting loads, forms between the shaft and the bearing bore.

The oil should not exceed a maximum admissible temperature, because the viscosity decreases with increasing temperature, and the friction characteristics are impaired when a certain temperature is exceeded. Too high an oil temperature also accelerates the aging of the oil, wherein the lubricating characteristics of the oil are also impaired. Both of these phenomena shorten the service intervals for oil changes and can pose a risk to the functional capability of the bearing, wherein even irreversible destruction of the bearing and therefore of the turbocharger is possible.

For the above reasons, the bearing housing of a turbocharger of an internal combustion engine is frequently equipped with a liquid-cooling arrangement. Here, a distinction is made between the liquid-cooling arrangement of the bearing housing and the abovementioned liquid-cooling arrangement of the turbine housing. Nevertheless, the two liquid-cooling arrangements may—if appropriate only intermittently—be connected to one another, that is to say communicate with one another.

In contrast to the engine cooling or cooling of the turbine housing, the cooling of the bearing housing may be maintained even when the vehicle has been shut down, that is to say the internal combustion engine has been switched off, at least for a certain period of time after the internal combustion engine has been switched off in order to prevent irreversible damage as a result of thermal overloading.

This may basically be realized by an additional, electrically operated pump to which electricity is supplied for example by the on-board battery, which pump conveys coolant via a connecting line through the bearing housing when the internal combustion engine has been switched off and thereby ensures cooling of the bearing housing and of the bearing even when the internal combustion engine is not in operation. The provision of an additional pump is however a relatively expensive measure.

Also known are concepts which dispense with an additional pump. Here, a rising line is laid through the bearing housing of the exhaust-gas turbocharger, which rising line functions as a connecting line and leads through the bearing housing from the cooling circuit of the engine cooling arrangement to the ventilation vessel. The conveying of the coolant when the internal combustion engine is switched off is realized by the so-called thermosiphon effect, which is based substantially on two mechanisms.

Owing to the introduction of heat—which continues even when the internal combustion engine is switched off—from the heated bearing housing into the coolant situated in the rising line, the coolant temperature increases, as a result of which the density of the coolant decreases and the volume taken up by the coolant increases. Superheating of the coolant may furthermore lead to a partial evaporation of coolant, such that coolant passes into the gaseous phase. In both cases, the coolant takes up a larger volume, as a result of which ultimately further coolant is displaced, that is to say conveyed, in the direction of the ventilation vessel.

The formation of the cooling arrangement of the bearing housing using a rising line and utilizing the thermosiphon effect however does not lead to a supply of coolant to the bearing housing according to demand, which yields disadvantages.

Without further measures, coolant will be conveyed via the rising line through the bearing housing into the ventilation vessel even during the warm-up phase after a cold start, even though cooling of the bearing is not required at this time. The undesired conveying of coolant also opposes the desired fast warm-up of the assemblies to a minimum temperature or operating temperature.

Furthermore, the coolant throughput through the ventilation vessel should be as low as possible in particular at low coolant temperatures. The throughput should advantageously be completely prevented for as long as the coolant has not exceeded a predefinable minimum temperature. Firstly, a degassing process, that is to say a ventilation process, requires that the coolant is in the ventilation vessel for a certain residence time, for which reason the throughput should fundamentally be limited. Secondly, a low temperature of the coolant, or the higher viscosity of the coolant on account of the low temperature, has the effect that the coolant is enriched with air again as it flows out of the ventilation vessel—contrary to the actual objective. The latter is a basic problem with ventilation by ventilation vessels, but is particularly pronounced at low coolant temperatures, whereas toward higher temperatures, the re-enrichment of the coolant with air does not take place or can be disregarded. The coolant throughput likewise has an—albeit secondary—influence on the re-enrichment of the coolant with air, wherein an increasing throughput intensifies the effect.

The inventors herein have recognized the issues with the above approach and provide a supercharged liquid-cooled internal combustion engine to at least partly address them. In one example, a supercharged liquid-cooled internal combustion engine comprises a cylinder head connected at an assembly end side to a cylinder block. The engine also includes a cooling circuit including a pump for conveying coolant, a heat exchanger, and a ventilation vessel, and an exhaust-gas turbocharger including a compressor and a turbine arranged on a shaft which is rotatably mounted in a liquid-cooled bearing housing. The bearing housing is connected into the cooling circuit by a connecting line and arranged between the pump and the ventilation vessel. A valve is controlled as a function of coolant temperature arranged in the connecting line between the pump and the ventilation vessel.

According to the disclosure, the conveying of coolant via the connecting line through the bearing housing is prevented or minimized by a valve at low coolant temperatures, in particular during the warm-up phase after a cold start of the internal combustion engine. Together with the undesired conveying of coolant at low coolant temperatures, the problem, which arises in particular at said temperatures, of the re-enrichment of the coolant with air as it exits the ventilation vessel is also eliminated.

As a valve, use may be made of a self-controlled valve which, as a function of the coolant temperature, varies the flow cross section of the connecting line and thereby controls the coolant throughput through the bearing housing, in such a way that the throughput is increased with rising coolant temperature. Consequently, in the internal combustion engine according to the disclosure, not only is the undesired conveying of coolant at low temperatures counteracted, but rather also the conveying of coolant and therefore the cooling action is accelerated, that is to say increased, toward high temperatures by an increase in the throughput, that is to say by an opening of the valve. This results in a supply of coolant to the bearing housing according to demand, wherein the conveying of the coolant is based on the thermosiphon effect.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
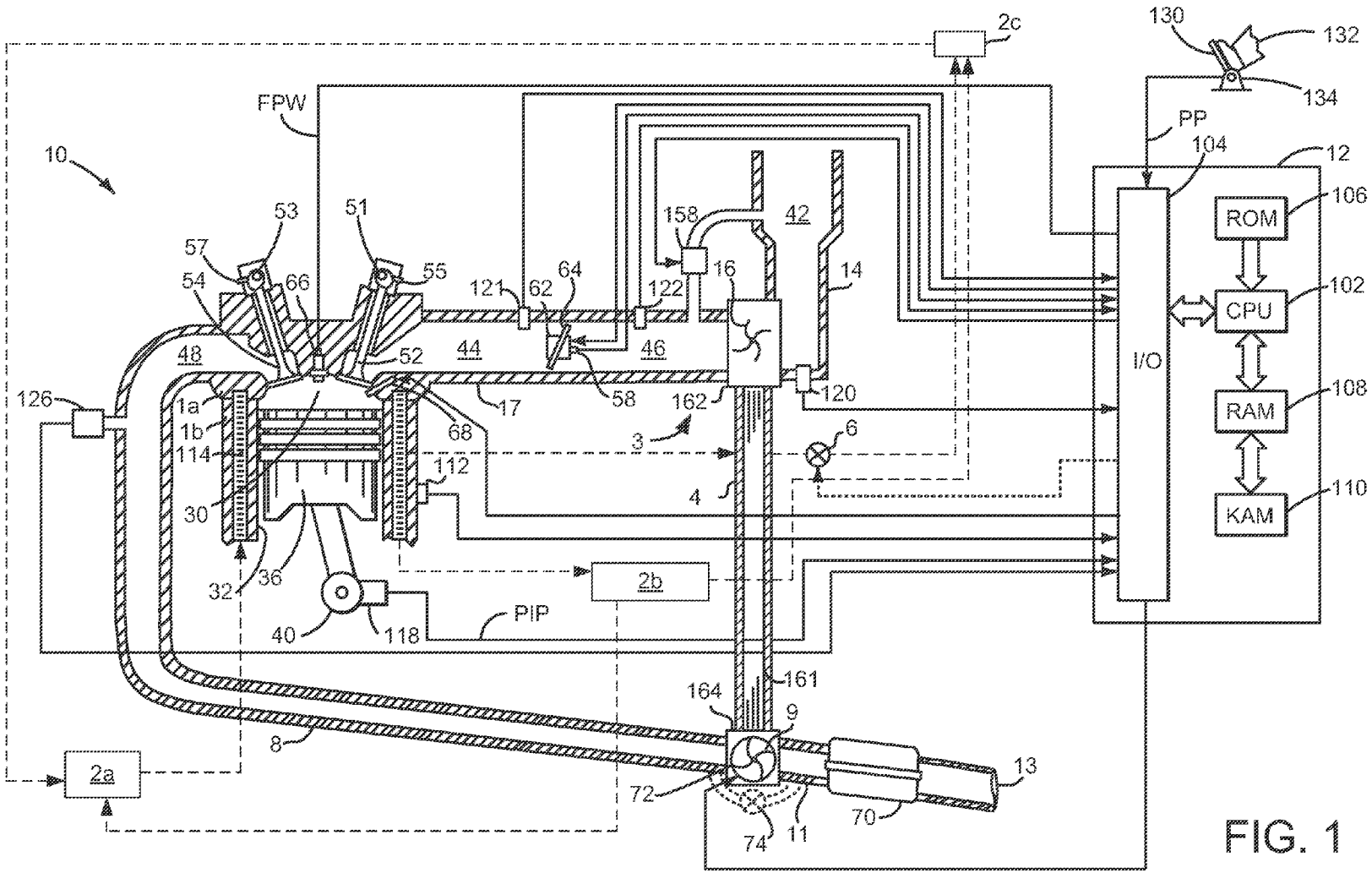
FIG. 1 schematically shows a non-limiting example of an engine including a supercharger.

The internal combustion engine according to the disclosure provides a supercharged liquid-cooled internal combustion engine which is optimized with regard to the cooling of the bearing housing and of the shaft bearing of the exhaust-gas turbocharger.

The valve is arranged in the connecting line, wherein within the context of the present disclosure, the entire line section between the pump and the ventilation vessel is referred to as a connecting line, specifically regardless of whether the line leads through other components or assemblies such as for example the cylinder head, the cylinder block or the bearing housing.

In the case of internal combustion engines having at least two cylinders, examples are advantageous in which each cylinder has at least one outlet opening for discharging the exhaust gases out of the cylinder and each outlet opening is adjoined by an exhaust line, wherein the exhaust lines of at least two cylinders merge within the cylinder head to form at least one overall exhaust line such that at least one exhaust manifold is formed, which overall exhaust line opens into the at least one turbine which has a turbine housing.

In the case of the supercharging of an internal combustion engine by an exhaust-gas turbocharger, it is sought to arrange the at least one turbine as close as possible to the outlet openings of the cylinders in order thereby to be able to optimally utilize the exhaust-gas enthalpy of the hot exhaust gases, which is determined significantly by the exhaust-gas pressure and the exhaust-gas temperature, and to ensure a fast response behavior of the turbine or of the turbocharger. Furthermore, the path of the hot exhaust gases to the different exhaust-gas aftertreatment systems should also be as short as possible such that the exhaust gases are given little time to cool down and the exhaust-gas aftertreatment systems reach their operating temperature or light-off temperature as quickly as possible, in particular after a cold start of the internal combustion engine.

It is therefore sought to minimize the thermal inertia of the part of the exhaust line between the outlet opening at the cylinder and the turbine or between the outlet opening at the cylinder and the exhaust-gas aftertreatment system, which can be achieved by reducing the mass and the length of said part.

Here, it is expedient for the exhaust lines to merge within the cylinder head so as to form at least one integrated exhaust manifold. The length of the exhaust lines is reduced in this way. The line volume, that is to say the exhaust-gas volume of the exhaust lines upstream of the turbine, is reduced, such that the response behavior of the turbine is improved. The shortened exhaust lines also lead to a reduced thermal inertia of the exhaust system upstream of the turbine, such that the temperature of the exhaust gases at the turbine inlet is increased, as a result of which the enthalpy of the exhaust gases at the inlet of the turbine is also higher. Furthermore, the merging of the exhaust lines within the cylinder head permits dense packaging of the drive unit.

In the case of internal combustion engines having three or more cylinders, examples are also advantageous in which at least three cylinders are configured in such a way as to form two groups with in each case at least one cylinder, and the exhaust lines of the cylinders of each cylinder group merge in each case into an overall exhaust line so as to form an exhaust manifold.

Said example is suitable in particular for the use of a twin-channel turbine. A twin-channel turbine has an inlet region with two inlet ducts, with the two overall exhaust lines being connected to the twin-channel turbine in such a way that in each case one overall exhaust line opens out into one inlet duct. The merging of the two exhaust-gas flows which are conducted in the overall exhaust lines takes place if appropriate downstream of the turbine. The grouping of the cylinders or exhaust lines however also offers advantages for the use of a plurality of turbines or exhaust-gas turbochargers, with in each case one overall exhaust line being connected to one turbine.

The at least one turbine may be designed as a radial turbine, that is to say the flow approaching the rotor blades runs substantially radially. Here, "substantially radially" means that the speed component in the radial direction is greater than the axial speed component. The speed vector of the flow intersects the shaft or axle of the turbine, specifically at right angles if the approaching flow runs exactly radially. To make it possible for the rotor blades to be approached by flow radially, the inlet region for the supply of the exhaust gas is often designed as an encircling spiral or worm housing, such that the inflow of exhaust gas to the turbine runs substantially radially.

The at least one turbine may however also be designed as an axial turbine in which the speed component in the axial direction is greater than the speed component in the radial direction.

The at least one turbine may be equipped with a variable turbine geometry, which enables a more precise adaptation to the respective operating point of an internal combustion engine by means of an adjustment of the turbine geometry or of the effective turbine cross section. Here, adjustable guide blades for influencing the flow direction are arranged in the inlet region of the turbine. In contrast to the rotor blades of the rotating rotor, the guide blades do not rotate with the shaft of the turbine.

If the turbine has a fixed, invariable geometry, the guide blades are arranged in the inlet region so as to be not only stationary but rather also completely immovable, that is to say rigidly fixed. In contrast, in the case of a variable geometry, the guide blades are duly also arranged so as to be stationary but not so as to be completely immovable, rather so as to be rotatable about their axes, such that the flow approaching the rotor blades can be influenced.

To improve the torque characteristics of the internal combustion engine, it is fundamentally also possible to use a plurality of turbochargers whose turbines and compressors are arranged in series or parallel.

Referring now to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into combustion chamber 30, which is known to those skilled in the art as direct injection. Fuel injector 66 delivers fuel in proportion to the pulse width of signal FPW from controller 12. Fuel is delivered to fuel injector 66 by a fuel system (not shown) including a fuel tank, fuel pump, fuel rail (not shown). Fuel pressure delivered by the fuel system may be adjusted by varying a position valve regulating flow to a fuel pump (not shown). In addition, a metering valve may be located in or near the fuel rail for closed loop fuel control. A pump metering valve may also regulate fuel flow to the fuel pump, thereby reducing fuel pumped to a high pressure fuel pump.

Intake manifold 44 is shown communicating with optional electronic throttle 62 via supply line 17, and electronic throttle 62 adjusts a position of throttle plate 64 to control air flow from intake boost chamber 46. Turbocharger 3 includes compressor 162 which draws air from air intake inlet 42 via inlet air line 14 and compressor vanes or blades 16 to supply air to boost chamber 46. Exhaust gases spin turbine vane or blade 9 of turbine 164 which is coupled to compressor 162 via shaft 161. In some examples, a charge air cooler may be provided. Compressor speed may be adjusted via adjusting a position of variable vane control 72 or compressor bypass valve 158. In alternative examples, a waste gate 74 may replace or be used in addition to variable vane control 72. Variable vane control 72 adjusts a position of variable geometry turbine vanes 9. Exhaust gases can pass through turbine 164 supplying little energy to rotate turbine 164 when vanes are in an open position. Exhaust gases can pass through turbine 164 and impart increased force on turbine 164 when turbine vanes 9 are in a closed position. Alternatively, wastegate 74 allows exhaust gases to flow around turbine 164 so as to reduce the amount of energy supplied to the turbine. Compressor bypass valve 158 allows compressed air at the outlet of compressor 162 to be returned to the input of compressor 162. In this way, the efficiency of compressor 162 may be reduced so as to affect the flow of compressor 162 and reduce intake manifold pressure.

Combustion is initiated in combustion chamber 30 when fuel automatically ignites as piston 36 approaches top-dead-center compression stroke. In some examples, a universal Exhaust Gas Oxygen (UEGO) sensor 126 may be coupled to exhaust manifold 48 upstream of emissions device 70. Discharge line 8 directs exhaust gases to turbine 164. In other examples, the UEGO sensor may be located downstream of one or more exhaust after treatment devices. Further, in some examples, the UEGO sensor may be replaced by a NOx sensor that has both NOx and oxygen sensing elements. Exhaust gas exits at exhaust system opening 13.

At lower engine temperatures glow plug 68 may convert electrical energy into thermal energy so as to raise a temperature in combustion chamber 30. By raising temperature of combustion chamber 30, it may be easier to ignite a cylinder air-fuel mixture via compression.

Emissions device 70 can include a particulate filter and catalyst bricks, in one example. In another example, multiple emission control devices, each with multiple bricks, can be used. Emissions device 70 can include an oxidation catalyst in one example. In other examples, the emissions device may include a lean NOx trap, a selective catalyst reaction (SCR) catalyst, lean NOx trap (LNT), and/or a diesel particulate filter (DPF).

Controller 12 is shown in FIG. 1 as a conventional microcomputer including: microprocessor unit 102, input/output ports 104, read-only memory 106, random access memory 108, keep alive memory 110, and a conventional data bus. Controller 12 may store instructions to carry out one or more control routines, such as the method described below with respect to FIG. 3. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a measurement of engine manifold pressure (MAP) from pressure sensor 121 coupled to intake manifold 44; boost pressure from pressure sensor 122 exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Also depicted in the example of FIG. 1 are components of a cooling circuit according to an example of the present disclosure. The cooling circuit may include a pump 2*a*, heat exchanger 2*b*, and ventilation vessel 2*c* as well as corresponding coolant lines, depicted as the dashed lines in FIG. 1. Further, a bearing housing 4 of the turbocharger shaft 161 may be supplied with coolant from the engine after passing through the cylinder block 1*b* and/or cylinder head 1*a*. To control flow of coolant through the bearing housing 4, a valve 6 may be included. Valve 6 may be a manual that is controlled internally based on coolant temperature, for example. In other embodiments, valve 6 may be an automatic valve that is controlled by controller 12 based on one or more operating parameters, including engine load, coolant temperature, etc. Additional information regarding the cooling circuit will be described below with respect to FIG. 2.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle. In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

While the example depicted in FIG. 1 includes a diesel engine, the expression "internal combustion engine" as used herein may encompass diesel engines, spark-ignition engines (e.g., gasoline) and also hybrid internal combustion engines.

Figure 2:
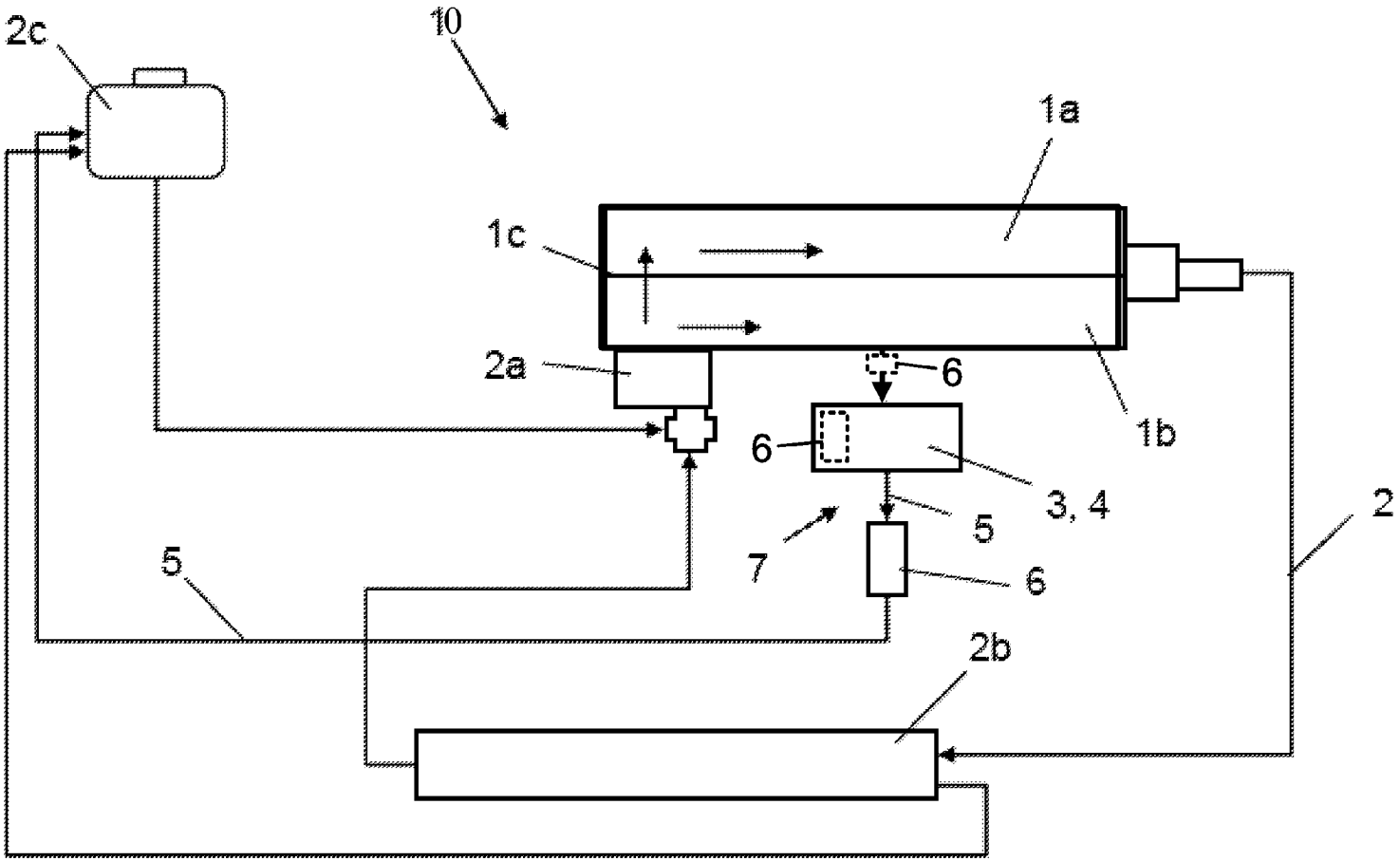
FIG. 2 schematically shows the supercharged liquid-cooled internal combustion engine together with the coolant flows.

FIG. 2 schematically shows the supercharged liquid-cooled internal combustion engine 10 together with the coolant flows (indicated by arrows). The internal combustion engine 10 comprises a cylinder head 1*a* which is connected at an assembly end side 1*c* to a cylinder block 1*b*.

To form the engine cooling arrangement 2, a pump 2*a* is provided upstream of the cylinder block 1*b* and directly adjacent to the cylinder block 1*b*, by which pump coolant is conveyed through a cooling circuit 2. Here, the coolant flows through the cylinder block 1*b* and the cylinder head 1*a* and, downstream, is supplied back to the pump 2*a* via a heat exchanger 2*b*, and the cooling circuit 2 is thereby closed. The radiator 2*b* which serves as a heat exchanger 2*b* is connected to a ventilation vessel 2*c* from which the coolant is supplied back to the cooling circuit 2 by being introduced into the cooling circuit 2 upstream of the pump 2*a*.

For the supercharging of the internal combustion engine 10, an exhaust-gas turbocharger 3 is provided which comprises a compressor and a turbine which are arranged on a common shaft. The shaft is rotatably mounted in a liquid-cooled bearing housing 4.

To form the liquid-cooling arrangement 7, the bearing housing 4 is connected into the cooling circuit 2 of the internal combustion engine 10, for which purpose a connecting line 5 is provided between the pump 2*a* and the ventilation vessel 2*c*.

In the example illustrated in FIG. 2, the connecting line 5 in which the bearing housing 4 is arranged leads through the cylinder block 1*b*. A valve 6 which is self-controlled as a function of the coolant temperature is arranged in the connecting line 5 downstream of the bearing housing 4, which valve serves for controlling the coolant throughput.

At low coolant temperatures, the conveying of coolant through the bearing housing 4 is prevented or minimized by the closure of the valve 6. At low coolant temperatures, the valve 6 is situated in the closed position. An enrichment of the coolant with air as it flows through the ventilation vessel 2*c* is thereby counteracted.

The valve 6 opens up a more or less large flow cross section of the connecting line 5 as a function of the coolant temperature, and thereby increases the conveying of coolant, or the cooling of the housing 4, with increasing coolant temperature. This results in a supply of coolant to the bearing housing 4 according to heat load demand. For example, as the temperature of coolant at the bearing increases, the valve opens further to allow additional coolant to pass through the bearing housing 4.

Examples of the internal combustion engine are advantageous in which the connecting line is formed as a rising line. To utilize or improve the thermosiphon effect, it is advantageous for the connecting line to be formed, at least upstream of the bearing housing, as a rising line in which the geodetic height continuously increases.

Examples of the internal combustion engine are advantageous in which the valve is arranged upstream of the bearing housing in the connecting line. In particular, however, examples of the internal combustion engine are advantageous in which the valve is arranged downstream of the bearing housing in the connecting line.

In contrast to the above example, a manual valve (e.g., a thermostat valve) used according to the disclosure is in the present case impinged on by coolant heated in the bearing housing. This is advantageous because the valve can react virtually without delay to the temperature of the coolant in the bearing housing, and therefore, in the control of the coolant throughput, is geared directly to the present thermal management in the bearing housing.

In the case of a valve arranged upstream of the bearing housing, there is inevitably a time delay resulting from the fact that the coolant situated in the connecting line between the valve and the bearing housing may initially be heated by heat conduction before the valve can react, by opening, to the temperatures prevailing in the housing.

Nevertheless—as already mentioned—examples are also advantageous in which the valve is arranged upstream of the bearing housing in the connecting line.

Examples of the internal combustion engine are advantageous in which the valve is integrated into the bearing housing. Said example permits a delay-free reaction to the temperatures in the bearing housing. Furthermore, parts of the valve, for example the valve housing, may be jointly formed by the bearing housing. This yields further advantages, in particular a compact design and a weight saving.

Examples of the internal combustion engine are advantageous in which the valve is integrated into the internal combustion engine. Advantages are obtained with regard to packaging and weight, as already described in conjunction with the above example, for which reason reference is made to the corresponding statements.

Examples of the internal combustion engine are advantageous in which the connecting line leads through the cylinder block.

In the installed position, the cylinder block is generally arranged low in the engine bay, that is to say at a geodetic height which is low in relation to the turbine. If the connecting line then leads through the cylinder block upstream of the turbine, this is advantageous in particular with regard to the utilization of the thermosiphon effect and the formation of the connecting line as a rising line. In this configuration, the turbine and the bearing housing to be cooled are arranged geodetically higher than the cylinder block.

Examples of the internal combustion engine may however also be advantageous in which the connecting line leads through the cylinder head.

In the case of internal combustion engines in which the turbine is arranged above the cylinder block, on that side of the assembly end side which faces toward the cylinder head, the connecting line may also lead from the cylinder head to the bearing housing of the turbine without the need to dispense with the formation of the line as a rising line.

Said arrangement of the turbine above the assembly end side makes it possible for even large-volume exhaust-gas aftertreatment systems to be located in a close-coupled position downstream of the turbine.

Examples of the internal combustion engine are advantageous in which the valve is continuously adjustable. A continuously adjustable valve permits a supply of coolant to the bearing housing according to demand in all operating states, wherein the present coolant temperature can be correspondingly followed by adjusting the valve in the direction of the closed position or open position. A continuously adjustable valve may include a plurality of restriction points.

Examples of the internal combustion engine are also advantageous in which the valve can be switched in a two-stage fashion. Said example is characterized in that the valve can be switched only between a closed position and an open position, that is to say can assume only two switching states. Thus, the valve may include only two positions or restriction points. Cost advantages are obtained in relation to the above example.

Examples of the internal combustion engine are advantageous in which the valve has a leakage flow in the closed position. Said leakage flow prevents a complete closure of the connecting line at low temperatures, as a result of which the conveying of coolant cannot be completely prevented. Nevertheless, a certain degree of leakage of the valve is advantageous in order to ensure that the thermal element which is arranged in the valve and which ultimately initiates the opening process is constantly impinged on by coolant.

Figure 3:
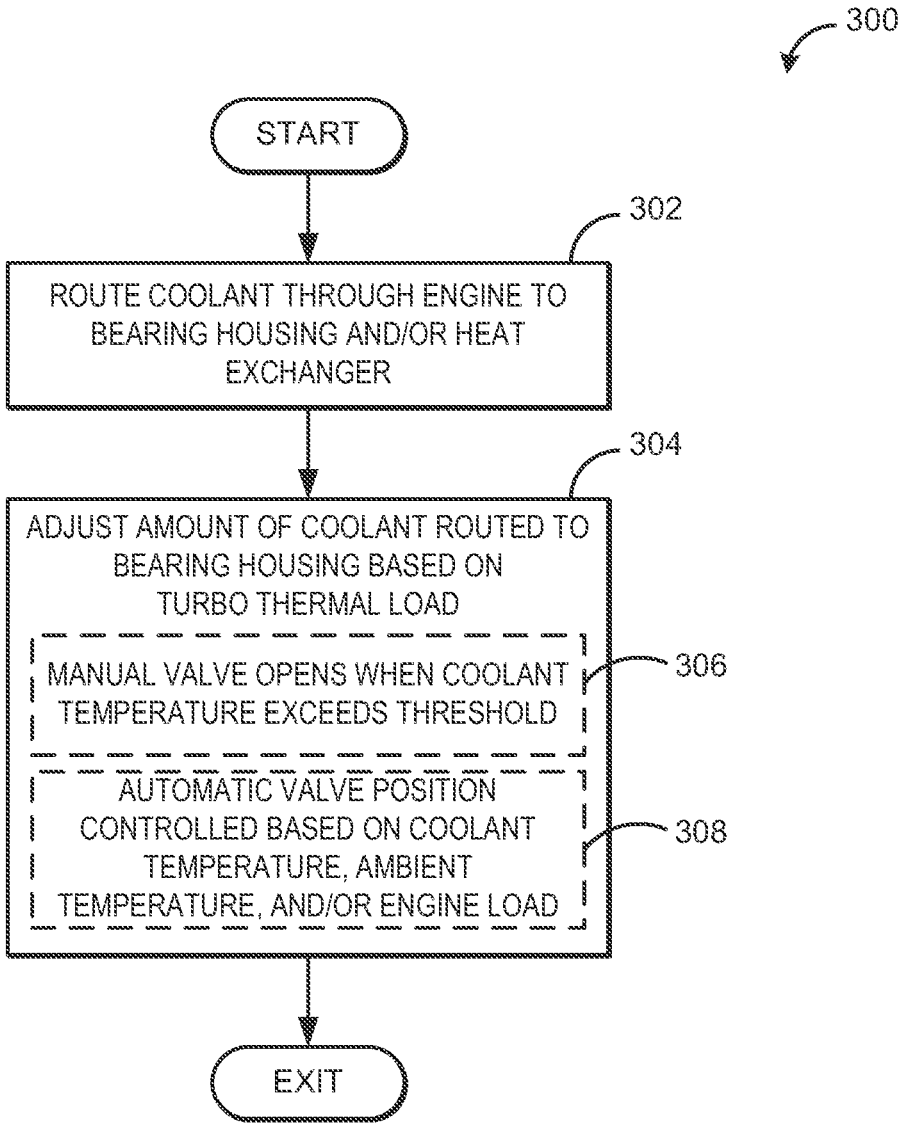
FIG. 3 is a flow chart depicting a method for cooling a turbocharger according to an example of the present disclosure.

FIG. 3 is a flow chart depicting a method 300 for cooling a turbocharger. Method 300 may be carried out in a coolant circuit of an engine, such as the coolant circuit described above with respect to FIG. 2. Method 300 includes, at 302, routing coolant through the engine to a bearing housing of a turbocharger and/or a heat exchanger. As explained above, a pump may direct coolant into the engine through the cylinder block and/or cylinder head. The coolant may then travel in a coolant line to the bearing housing of a turbocharger coupled to the engine. Further, once the coolant has passed through the engine, it may travel in another coolant line to a heat exchanger in order to transfer the heat from the engine to a passenger cabin of a motor vehicle, for example.

At 304, method 300 includes adjusting an amount of coolant that is routed to the bearing housing based on a thermal load of the turbocharger. In some examples this may include, at 306, routing coolant through a manual valve that is configured to open when coolant temperature exceeds a threshold. The threshold temperature may be a suitable temperature that indicates a high thermal load on the turbocharger, such as normal engine operating temperature. In another example, this may include, at 308, controlling an automatic valve position based on coolant temperature near the shaft bearing (e.g., within the turobocharger), ambient temperature, and/or engine load. In this way, with the automatic valve, thermal loading on the turbocharger may be anticipated based on the above factors, and the valve adjusted to route a desired amount of coolant to the bearing housing to cool the turbocharger without over-cooling. For example, if engine load is high and ambient temperature is high, the valve may be controlled to open even if coolant temperature is still relatively low, so that as the thermal load on the turbocharger increases, coolant will be routed to the bearing housing without the delay that would result if only coolant temperature controlled the position of the valve. However, in some examples, the automatic valve may also be controlled only based on coolant temperature.

It will be appreciated that the configurations and methods disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for cooling a turbocharger coupled to an engine while controlling the flow of coolant to a ventilation vessel, comprising:

adjusting coolant flow, via a valve, through the engine to a bearing housing of the turbocharger and ventilation vessel based on a thermal load of the turbocharger, the valve further adjusted in response to one or more of engine load and ambient temperature, the valve arranged within a single line coupling a pump and the ventilation vessel via the bearing housing of the turbocharger.

2. The method of claim 1, wherein adjusting coolant flow to the bearing housing and ventilation vessel further comprises routing coolant through a manual valve coupled to the bearing housing, the manual valve opening when coolant temperature exceeds a threshold temperature.

3. A coolant circuit for an engine, comprising:

a bearing housing of a turbocharger arranged within a single line coupling a pump and a ventilation vessel, the pump providing coolant first to the bearing housing and then to the ventilation vessel via the engine, the ventilation vessel arranged downstream of the bearing housing and pump within the single line; and a valve configured to control coolant flow through the bearing housing and ventilation vessel based on coolant temperature.

4. The coolant circuit of claim 3, further comprising a controller including instructions to control a position of the valve based on coolant temperature and further based on engine load.

5. The coolant circuit of claim 4, wherein the valve includes a plurality of restriction points.

6. The coolant circuit of claim 3, wherein the valve is a manual valve configured to open when coolant temperature exceeds a threshold.

7. The coolant circuit of claim 6, wherein the manual valve includes two restriction points.

8. The coolant circuit of claim 6, wherein the manual valve includes a plurality of restriction points.

9. A supercharged liquid-cooled internal combustion engine comprising:

a cylinder head connected at an assembly end side to a cylinder block;

a cooling circuit including a pump for conveying coolant, a heat exchanger, and a ventilation vessel, the ventilation vessel arranged within a single connecting line provided between the pump and the ventilation vessel;

an exhaust-gas turbocharger including a compressor and a turbine arranged on a shaft which is rotatably mounted in a liquid-cooled bearing housing, the bearing housing arranged geodetically higher than the cylinder block in the single connecting line between the pump and the ventilation vessel; and a valve controlled in response to coolant temperature arranged in the single connecting line.

10. The supercharged liquid-cooled internal combustion engine as claimed in claim 9, wherein the connecting line is formed as a rising line.

11. The supercharged liquid-cooled internal combustion engine as claimed in claim 9, wherein the valve is arranged upstream of the bearing housing in the connecting line.

12. The supercharged liquid-cooled internal combustion engine as claimed in claim 9, wherein the valve is arranged downstream of the bearing housing in the connecting line.

13. The supercharged liquid-cooled internal combustion engine as claimed in claim 9, wherein the valve is integrated into the bearing housing.

14. The supercharged liquid-cooled internal combustion engine as claimed in claim 9, wherein the valve is integrated into the internal combustion engine.

15. The supercharged liquid-cooled internal combustion engine as claimed in claim 9, wherein the connecting line leads through the cylinder block.

16. The supercharged liquid-cooled internal combustion engine as claimed in claim 9, wherein the connecting line leads through the cylinder head.

17. The supercharged liquid-cooled internal combustion engine as claimed in claim 9, wherein the valve is continuously adjustable.

18. The supercharged liquid-cooled internal combustion engine as claimed in claim 9, wherein the valve includes two positions.

19. The supercharged liquid-cooled internal combustion engine as claimed in claim 9, wherein the valve has a leakage flow in a closed position.

* * * * *